US011629493B2

(12) United States Patent
Livingstone

(10) Patent No.: US 11,629,493 B2
(45) Date of Patent: Apr. 18, 2023

(54) STRUCTURAL MODULAR BUILDING PANEL, WALL, AND BUILDING SYSTEM

(71) Applicant: Patricia Mary Livingstone, Kelowna (CA)

(72) Inventor: Patricia Mary Livingstone, Kelowna (CA)

( * ) Notice: Subject to any disclaimer, the term of this patent is extended or adjusted under 35 U.S.C. 154(b) by 0 days.

(21) Appl. No.: 17/338,619

(22) Filed: Jun. 3, 2021

(65) Prior Publication Data

US 2021/0381237 A1 Dec. 9, 2021

Related U.S. Application Data

(60) Provisional application No. 63/034,281, filed on Jun. 3, 2020.

(51) Int. Cl.

| | |
|---|---|
| ***E04C 2/296*** | (2006.01) |
| ***E04B 1/14*** | (2006.01) |
| ***E04B 1/61*** | (2006.01) |
| ***E04B 7/22*** | (2006.01) |
| ***E04B 2/00*** | (2006.01) |
| ***E04B 5/02*** | (2006.01) |
| ***E04H 1/12*** | (2006.01) |
| ***E04C 2/38*** | (2006.01) |
| *E04C 2/00* | (2006.01) |

(52) U.S. Cl.

CPC ..... *E04C 2/296* (2013.01); *E04B 1/14* (2013.01); *E04B 1/6116* (2013.01); *E04B 7/22* (2013.01); *E04C 2/38* (2013.01); *E04C 2/46* (2013.01); *E04C 2/50* (2013.01); *E04H 1/1205* (2013.01); *E04B 2103/04* (2013.01); *E04C 2002/004* (2013.01)

(58) Field of Classification Search

CPC . E04B 1/6116; E04B 1/14; E04B 7/22; E04B 2103/04; E04C 2/284; E04C 2/46; E04C 2/50; E04C 2002/004; E04C 2/296; E04C 2/38; E04H 1/1205

USPC ..... 52/406.1, 406.2, 794.1

See application file for complete search history.

(56) References Cited

U.S. PATENT DOCUMENTS 5,815,989 A * 10/1998 Bennenk ..... E04D 3/352 52/80.1

7,377,082 B1 * 5/2008 Edwards ..... E04C 2/292 52/592.1

(Continued)

*Primary Examiner* — William V Gilbert

(57) ABSTRACT

This invention relates to prefabricated, lightweight, multi-component structural modular building panels and modular building systems. The said panels are framed with edge members that have a unique connecting shape, making them modular. The multi-component panel allows for design flexibility and the mass manufacturing of its components. Connectors serve as a link to assemble the panels together, and to connect them to corners, floors or foundations, roof panels and the roof apex member, and or other conventional construction elements. Connectors and members, all with unique connecting shapes, coupled with the said panels, create a structural wall, roof, similar structure or building system. Assembled panels and members incorporate the primary building structure and the building envelope. The assembled panels, members and other components of the building system, in part or whole, can be flat packed for easy transport and shipping, and can be assembled quickly and easily with semi-skilled labor.

2 Claims, 9 Drawing Sheets

(56) References Cited

U.S. PATENT DOCUMENTS

| | | | | |
|---|---|---|---|---|
| 8,677,713 | B1 * | 3/2014 | Sheehy | E04C 2/388 52/286 |
| 2002/0069600 | A1 * | 6/2002 | Bryant | E04B 1/12 52/794.1 |
| 2009/0025335 | A1 * | 1/2009 | Flynn | E04D 3/355 52/794.1 |
| 2009/0064622 | A1 * | 3/2009 | Gingras | E04C 2/292 52/584.1 |
| 2009/0205277 | A1 * | 8/2009 | Gibson | E04D 13/1625 52/656.1 |
| 2011/0173925 | A1 * | 7/2011 | Brown | F25D 23/06 52/794.1 |
| 2019/0383013 | A1 * | 12/2019 | Jarvie | E04C 2/40 |
| 2020/0217065 | A1 * | 7/2020 | Rosan | E04C 2/10 |

* cited by examiner

STRUCTURAL MODULAR BUILDING PANEL, WALL, AND BUILDING SYSTEM

CROSS-REFERENCE TO RELATED APPLICATIONS

This application claims priority to U.S. Provisional Application No. 63/034,281 filed on Jun. 3, 2020.

STATEMENT REGARDING FEDERALLY SPONSORED RESEARCH OR DEVELOPMENT

Not Applicable

REFERENCE TO SEQUENCE LISTING, A TABLE, OR A COMPUTER PROGRAM LISTING COMPACT DISC APPENDIX

Not Applicable

BACKGROUND OF THE INVENTION

The field of endeavor that this invention pertains to is construction. This invention relates to a lightweight, uniquely prefabricated, multi-component, structural modular building panel, framed with a unique proprietary connecting shape and the assembly process to connect unique frame edge members with the unique proprietary connecting shape, to face sheets and insulating core. This multi-component assembly allows for design flexibility and the mass manufacturing of components. These panels connect and/or fasten to unique building components such as corner members, track members, roof wall connectors and roof apex connectors, all with unique proprietary connecting shapes, to form walls, roofs, segments of a structure or building systems that can be flat pack shipped and easily assembled.

A large portion of construction costs for a typical building come from the various numbers of skilled trades required and their time spent on-site. The building construction industry has not seen the same improvements in output and efficiency that the manufacturing sector has seen. There have been some attempts made to improve the building industry and bring construction to a comparable manufacturing efficiency.

There exist modular building systems which make use of pultruded building panels made from fiber reinforced polymer (FRP). Similarly, there are also wall panel products made from extruded thermoplastics. The design flexibility of these types of panels are limited by the manufacturing technique, where the use of a die does not allow for variable dimensions in two directions, and where different features are not possible perpendicular to the direction of the extrusion/pultrusion. The ends of these panels are typically cut straight and left open with the hollow interior or insulation exposed.

Sandwich panels have seen more successful implementation in custom, commercial, industrial and government building construction, however, many lightweight designs only make up a portion of a wall system, and an underlying building structure is still required. Other sandwich panel products, known as Structural Insulated Panels (SIPs), which are made from oriented-strand-board (OSB), steel and cement (MGO) faces, and an expanded-polystyrene (EPS) core, or similar materials, still require a significant amount of on-site construction work to complete the connections, cladding, and finishing. This type of construction and amount of on-site work is better suited to larger residential, commercial and industrial projects rather than smaller residential and consumer buildings as the panels themselves are typically large and heavy, and require the use of heavy lifting machinery on-site.

There is a need for prefabricated, lightweight, modular building materials, structural modular panels and building systems which can be quickly and easily connected with semi-skilled labor, to erect walls, roofs, and/or buildings. The structural modular building panel may incorporate the primary building structure (axially & laterally load bearing), the insulation, sheathing, exterior cladding & interior finishing. This multi-component assembly may allow for design flexibility, the efficient use of manufacturing techniques, and a lower investment in manufacturing dies and tooling. These and other needs are alleviated, or at least attenuated, by the novel products and methods of the invention.

BRIEF SUMMARY OF THE INVENTION

This invention relates to a uniquely prefabricated, multi-component, structural modular building panel, assembled with frame edge members that have a unique proprietary connecting shape, which are made of composite FRP, or any other suitable material manufactured by a pultrusion process, or any other suitable method. These uniquely prefabricated, multi-component, building panels can be coupled and linked with connectors if required; and secured from the inside with mechanical fasteners to other unique panels and/or building component members with unique proprietary connecting shapes of the same construction; or building components that may or may not be of the same construction, to create a wall, roof, similar structure or building system for easy and quick on-site construction. The continuous manufacturing process of pultrusion is cost-efficient and eco-friendly. The composite FRP is corrosion-resistant, fire retardant, durable, has dimensional stability, thermal insulation and low conductivity. The uniquely prefabricated, multi-component, structural modular building panels in this invention are lightweight, making it easy to transport to out-of-the-way locations. Installation is simple and does not require skilled labor. These uniquely prefabricated, multi-component, structural modular building panels; unique building component members with unique proprietary connecting shapes; connectors with unique proprietary connecting shapes; and connectors are machined and predrilled to create minimal tolerances to ensure secure fastening, fit and finish. Only hand-tools and semi-skilled labor are required to assemble the building systems, eliminating the need for heavy equipment, welding or excessive site work. The unique structural modular building systems may be shipped in modules requiring limited assembly, or completely pre-assembled to drop into a location.

The unique multi-component, structural modular building panel comprises at least two thin face sheets and an insulating foam core, or can be any other suitable material, and unique frame edge members with a unique proprietary connecting shape. These unique frame edge members may be composite FRP, or any other suitable material manufactured by a pultrusion process, or any other suitable method, similar to fiberglass window and door frames. The face sheets may be made from fiber reinforced thermoset composites, advance composite materials or any other suitable materials. These face sheets may be used for different structural requirements or aesthetics, as dictated by the design requirements. They are bonded to the two outer faces of the insulating foam core, or any other suitable material, to create a structural sandwich panel. The unique frame edge members with a unique proprietary connecting shape, run along the perimeter of the sandwich panel and serve as both a structural member and an edge connection that allows the panel to be easily connected to an adjoining panel or other matching member. The unique frame edge members, with a unique proprietary connecting shape, may incorporate mechanical fasteners to make structural connections. The components are assembled in a single panel configuration that creates a unique prefabricated wall or roof panel, including the structure, weather sealing, insulation, and finishes.

The unique multi-component assembly design of the panel allows for design flexibility, with the innovative and efficient use of current manufacturing techniques, and a lower investment in manufacturing of tooling-dies. The components of the panel can be manufactured in different lengths and widths while using the same unique frame edge members with a unique proprietary connecting shape, and different face sheets may be used for different requirements or different aesthetics. The multi-component design also allows for the addition of internal features such as reinforcements, fasteners, electrical and plumbing elements. Internal features such as mechanical fastening points and conduit for utilities may be added to the panel and/or frame edge connections before the components are bonded together to form a structural modular building panel which can be coupled with other panels or components that may or may not be of the same construction to create a wall, roof, segments of a structure or building system.

This unique prefabricated, multi-component building panel design allows for the creation of lightweight building systems where complete walls are easy to assemble on site by a limited number of people. Structural connections between panels are by bolts or other suitable fastening mechanisms and easy to assemble by semi-skilled labor or the end user. Fastening mechanisms are located on the inside of the structure for various reasons, including increased security and protection from outside elements. Use of these panels may be advantageous where it is difficult to get the typically required skilled manpower or equipment to a jobsite, where a worksite has poor or difficult access, and where a shortened timeline of on-site work is desirable.

An example system may include using a plurality of uniquely prefabricated, multi-component, structural modular building panels with other panels or components that may or may not be of the same construction, to erect a Sustainable Manufactured Shelter (SMS) which is under 100 sq. ft. (i.e., utility or storage buildings) and may not require a building permit, depending on its location. The energy efficient utility building is erected from the expandable modular building system comprising insulated, uniquely prefabricated, multi-component, structural modular building panels with connecting unique frame edge members, corner assemblies, track assemblies, roof assemblies and other components made of a composite FRP pultrusion or other suitable material. The outside face sheets can look like wood, brick or stucco & the interior can be a wall covering that is paintable. This eliminates the need for outside (stucco) or inside (drywall) finishing labor & materials. The roof panels of the utility building may be comprised of silicon solar wafers or other similar material to provide a renewable energy source for the building and other purposes. The utility building may include active noise cancellation technology or other previous or future innovations.

The foregoing summary is illustrative only and is not intended to be in any way limiting. In addition to the illustrative aspects, embodiments, and features described above, further aspects, embodiments, and features will become apparent by reference to the drawings and the following detailed description. It is to be understood that other aspects of the present invention will become readily apparent, to those skilled in the art, from the following detailed description, wherein various embodiments of the invention are shown and described by way of illustration. As will be realized, the invention is capable of other and different embodiments and its several details are capable of modification in various other respects, all within the present invention. Furthermore, the various embodiments described may be combined, mutatis mutandis, with other embodiments described herein. Accordingly, the drawings and detailed description are to be regarded as illustrative in nature and not as restrictive.

BRIEF DESCRIPTION OF ITEMS

ITEM 1 is a unique side frame edge member with a unique proprietary connecting shape.

ITEM 2 is a unique side frame edge member with a unique proprietary connecting shape.

ITEM 3 is a unique upper frame edge member with a unique proprietary connecting shape.

ITEM 4 is a unique bottom frame edge member with a unique proprietary connecting shape.

ITEM 5 is an exterior face sheet.

ITEM 6 is an interior face sheet.

ITEM 7 is an insulating core.

ITEM 8 is a fastening bolt.

ITEM 9 is a fastening nut.

ITEM 10 is a connector.

ITEM 11 is a weather strip.

ITEM 12 is an internal reinforcing element.

ITEM 13 is an adhesive/a bonding material.

ITEM 14 is an optional internal backing board.

ITEM 15 is a unique corner member with a unique proprietary connecting shape.

ITEM 16 is a unique track member with a unique proprietary connecting shape.

ITEM 17 is a uniquely prefabricated multi-component wall panel.

ITEM 18 is a uniquely prefabricated multi-component roof panel.

ITEM 19 is a unique roof wall connector with a unique proprietary connecting shape.

ITEM 20 is a unique roof apex connector with a unique proprietary connecting shape.

ITEM 21 is a floor, foundation or any other suitable material.

ITEM 22 is an anchor bolt or any other suitable anchoring or fastening system.

ITEM 23 is a unique corner member (item 15) used as a unique eave member.

ITEM 24 is a uniquely prefabricated multi-component closing panel.

ITEM 25 is a uniquely prefabricated multi-component gable panel.

DETAILED DESCRIPTION OF THE SEVERAL VIEWS OF THE DRAWINGS

The foregoing and other features of the present disclosure will become more fully apparent from the following description as described herein, taken in conjunction with the accompanying drawings. Understanding that these drawings depict only several embodiments in accordance with the disclosure and are, therefore, not to be considered limiting of its scope, the disclosure will be described with additional specificity and detail through use of the accompanying drawings, which form a part of this specification.

Figure 1:
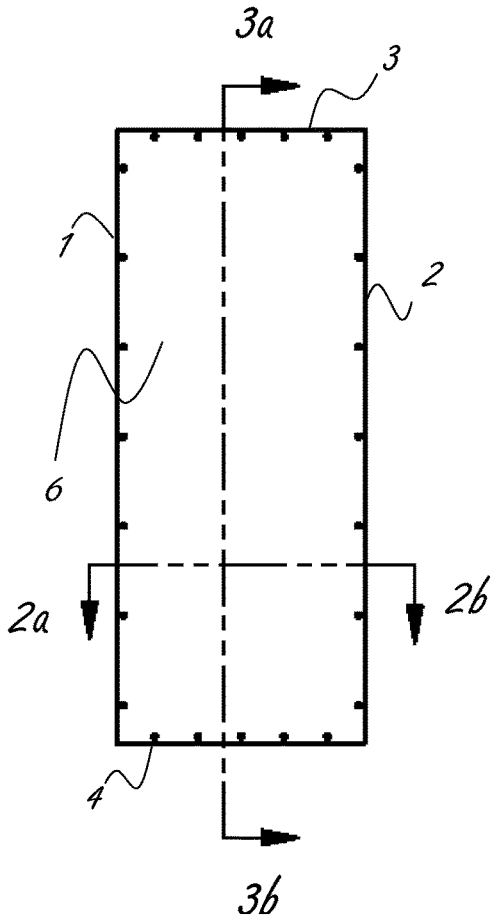
FIG. 1 illustrates the front view of a unique multi-component building panel assembly, with horizontal and vertical cross-section details 1 and 2 respectively.

FIG. 1 shows a front, inside view of an assembly of a unique multi-component, structural modular building panel, comprising, unique side frame edge members with a unique proprietary connecting shape items 1 and 2; unique upper and bottom frame edge members with a unique proprietary connecting shape, items 3 and 4; and, an interior face sheet, item 6, which may be a composite FRP or any other suitable material. Items 1 and 2, the unique side frame edge members with a unique proprietary connecting shape, and items 3 and 4, the unique upper and bottom frame edge members with a unique proprietary connecting shape, may be a composite FRP, manufactured by a pultrusion process, or any other suitable material manufactured by any other suitable method that satisfies the structural requirements of the application and/or structure. The panel assembly, in a suitable size and configuration of geometry, can be used as a multi-component wall panel, item 17; a multi-component roof panel, item 18; a multi-component closing panel, item 24; and a multi-component gable panel, item 25. The multi-component design of the panel enables them to be assembled to suit non-structural and structural applications.

Figure 2A:
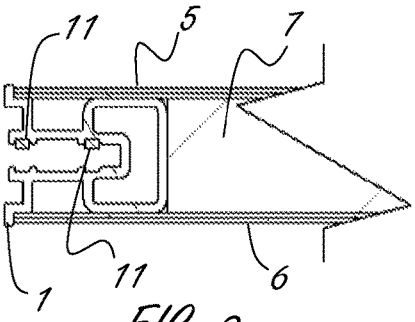
FIGS. 2*a* and 2*b* illustrate a typical horizontal cross-section of the unique multi-component building panel comprising unique side frame edge members with a unique proprietary connecting shape, marked as detail 2*a* and 2*b* in FIG. 1.
Figure 2B:
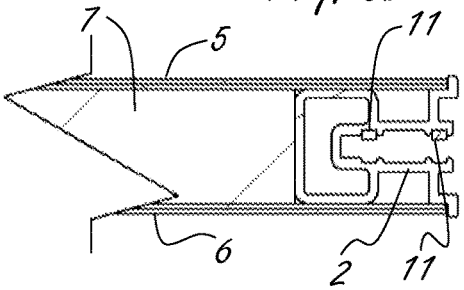

FIGS. 2*a* and 2*b* show a horizontal cross-section view of the panel assembly referenced as detail 2*a* and 2*b* in FIG. 1 with the unique side frame edge members with a unique proprietary connecting shape, items 1 and 2; exterior and interior face sheets which may be composite FRP sheets or any other suitable material, items 5 and 6; insulating core, which may be Expanded Polystyrene (EPS) or any other suitable material, item 7; weather strip, which may be flexible PU foam; weather seal assembly or any other suitable material, item 11. This illustrates various embodiments of the invention wherein the unique edge frame members with a unique proprietary connecting shape have cavities for electrical and plumbing, weather stripping, fastening bolts and nuts or any other suitable fastening system, and/or run-outs for excess adhesive/bonding material.

Figure 3A:
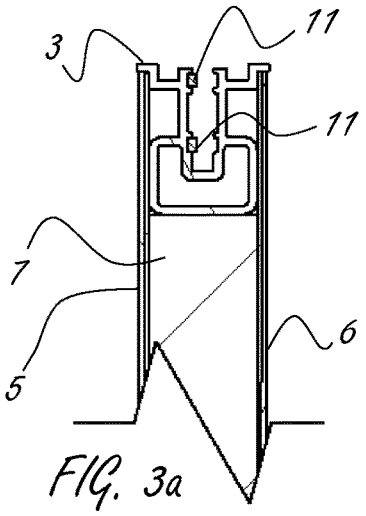
FIGS. 3*a* and 3*b* illustrate a typical vertical cross-section of the unique multi-component building panel comprising a unique upper frame edge member with a unique proprietary connecting shape and a unique bottom frame edge member with a unique proprietary connecting shape, marked as detail 3*a* and 3*b* in FIG. 1.
Figure 3B:
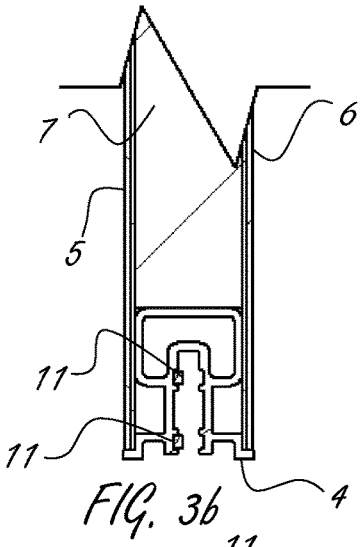

FIGS. 3*a* and 3*b* show a vertical cross-section view of the panel assembly referenced as detail 3*a* and 3*b* in FIG. 1, with the unique upper and bottom frame edge members with a unique proprietary connecting shape, items 3 and 4.

Figure 4:
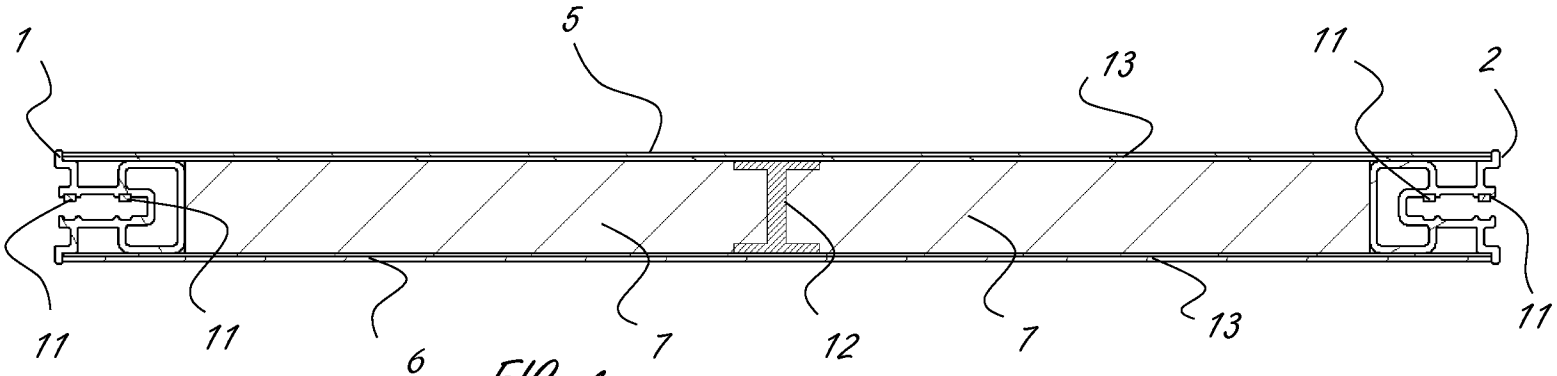
FIG. 4 illustrates a horizontal cross-section of a uniquely prefabricated multi-component building panel assembled using the unique side frame edge members with a unique proprietary connecting shape.

FIG. 4 shows a horizontal cross-section view of the panel assembly in FIG. 1, illustrating items 1 and 2, the unique side frame edge members with a unique proprietary connecting shape, which are coupled to items 5 and 6, the exterior and interior face sheets. It also illustrates an embodiment of the invention wherein item 12, an internal reinforcing element, which may be a composite FRP pultrusion or any other suitable material, may be added at the midpoint or any location within the panel as dictated by the function and the structural performance requirements of the said panel for an application. More than one of these internal reinforcing elements may be added to achieve the desired rating of the structural performance. Item 13 is an epoxy adhesive or any other suitable material, bonding items 5 and 6, the exterior and interior face sheets; to item 7, the insulating core; and to items 1 and 2, the unique side frame edge members with a unique proprietary connecting shape. This illustrates another benefit of the uniquely prefabricated building panel as it may seal and protect the components from environmental elements. This lessens the risk of condensation within the panels, hence decreasing the hazard of mold growing. The panel assembly can be used as a uniquely prefabricated multi-component wall panel, item 17; or a uniquely prefabricated multi-component roof panel, item 18; or a uniquely prefabricated multi-component closing panel, item 24; or a uniquely prefabricated multi-component gable panel, item 25.

Figure 5:
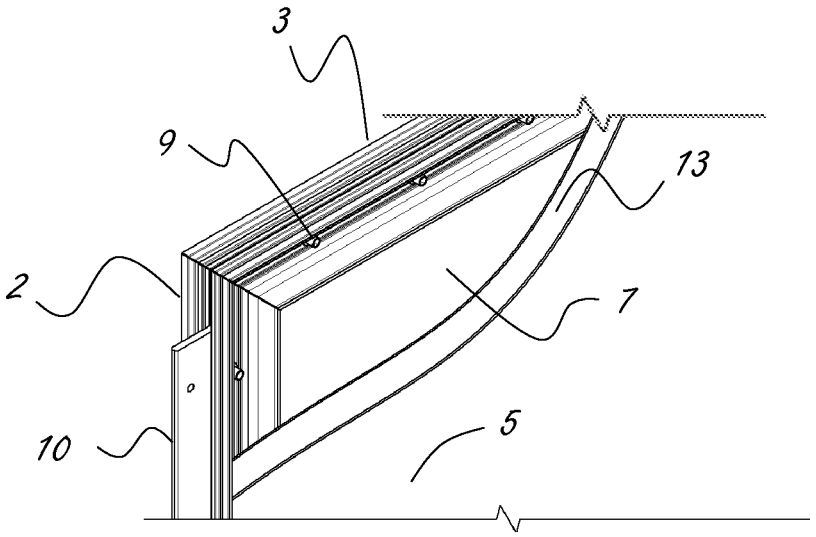
FIG. 5 illustrates a layered cut-out view of the uniquely prefabricated multi-component building panel.

FIG. 5 shows an isometric layered view of the panel assembly in FIG. 1 with a cutaway of item 5, the exterior face sheet, to show a joined corner of items 2 and 3, the unique frame edge members with a unique proprietary connecting shape. It illustrates item 2, the unique side frame with a unique proprietary connecting shape, with an inserted item 10, a connector, which may be a composite FRP pultrusion or any other suitable material. Item 13, the epoxy adhesive or any other suitable material bonds item 5, the exterior face sheet, to item 7, the insulating core; and to items 2 and 3, the frame edge members with a unique proprietary connecting shape.

Figure 6:
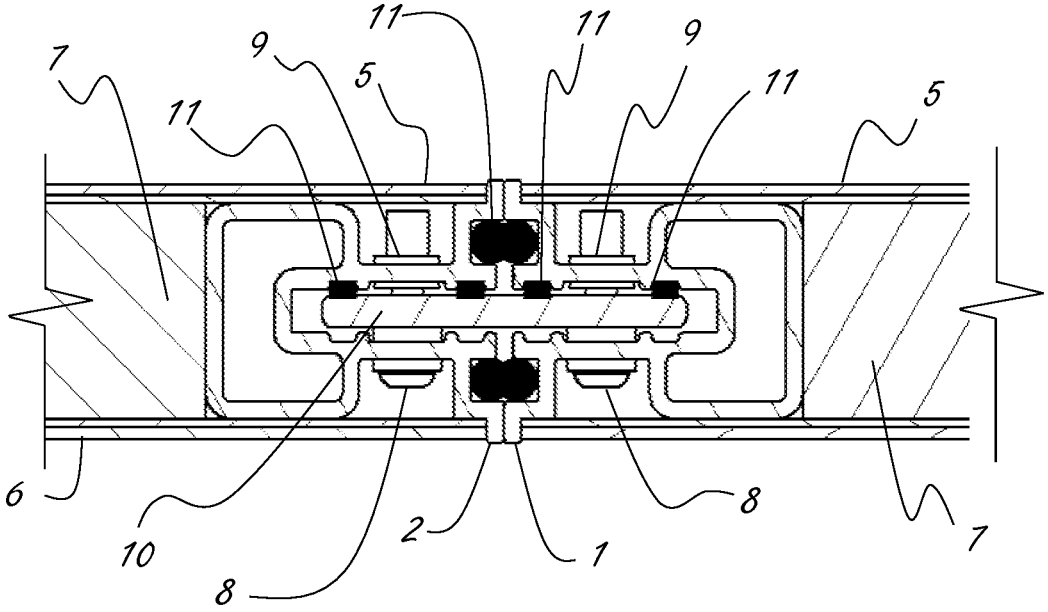
FIG. 6 illustrates a horizontal cross-section view of a typical connection detail of two of the unique multi-component building panels coupled with a connector and fasteners.

FIG. 6 shows a horizontal cross-sectional view of two of the unique multi-component building panel assemblies coupled utilizing items 1 and 2, the unique side frame edge members with a unique proprietary connecting shape, linked with item 10, a connector, and attached with items 8 and 9, fastening bolts and nuts or any other suitable fasteners or fastening mechanism. The connector and the unique proprietary connecting shapes allow multiple panels to be joined to form expandable building panel systems, such as expandable wall panel systems, expandable roof panel systems or similar segments of a structure. The connector also serves as a structural member wherein it transfers loads from one panel to the adjacent panel.

Figure 7:
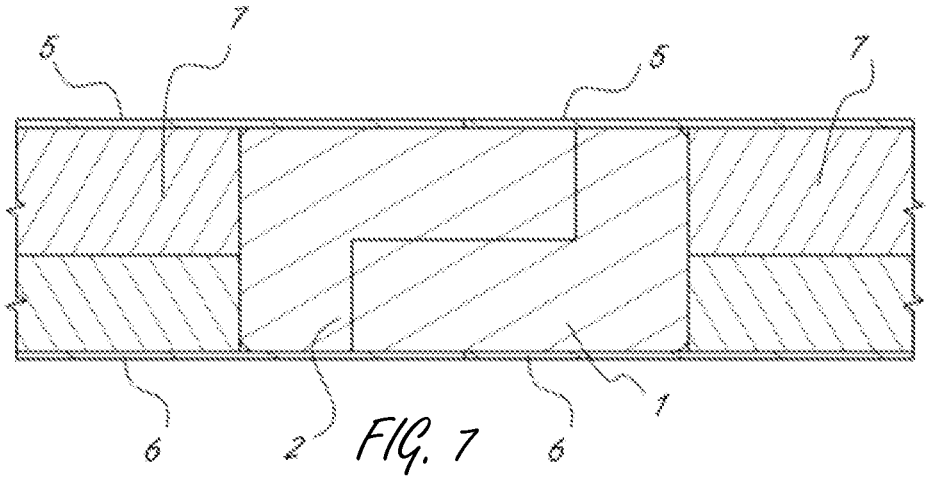
FIG. 7 illustrates an alternate horizontal cross-section connection of two coupled unique multi-component building panels.

FIG. 7 shows an alternate horizontal cross-sectional view of two of the unique multi-component, structural modular building panel assemblies coupled utilizing items 1 and 2, the unique frame edge members with a unique proprietary connecting shape and comprising item 7, the insulating core and items 5 and 6, the exterior and interior face sheets.

Figure 8:
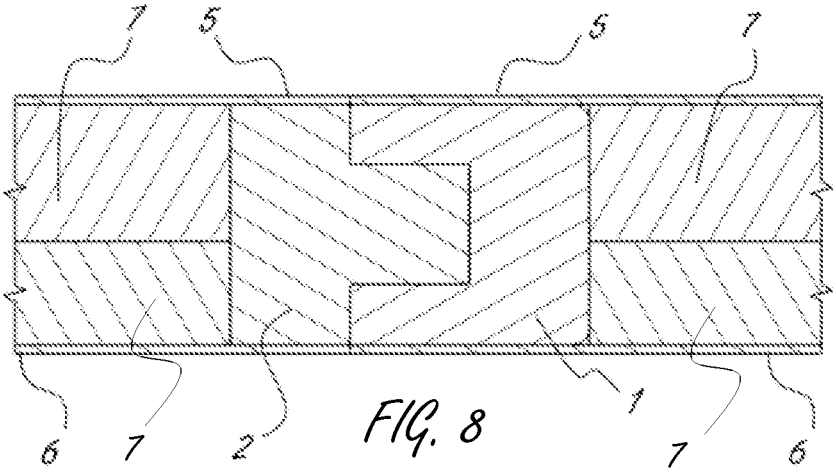
FIG. 8 illustrates an alternate horizontal cross-section connection of the two coupled unique multi-component building panels.

FIG. 8 shows an alternate horizontal cross-sectional view of two of the unique multi-component, structural modular building panel assemblies coupled utilizing items 1 and 2, the unique frame edge members with a unique proprietary connecting shape and comprising item 7, the insulating core and items 5 and 6, the exterior and interior face sheets.

Figure 9:
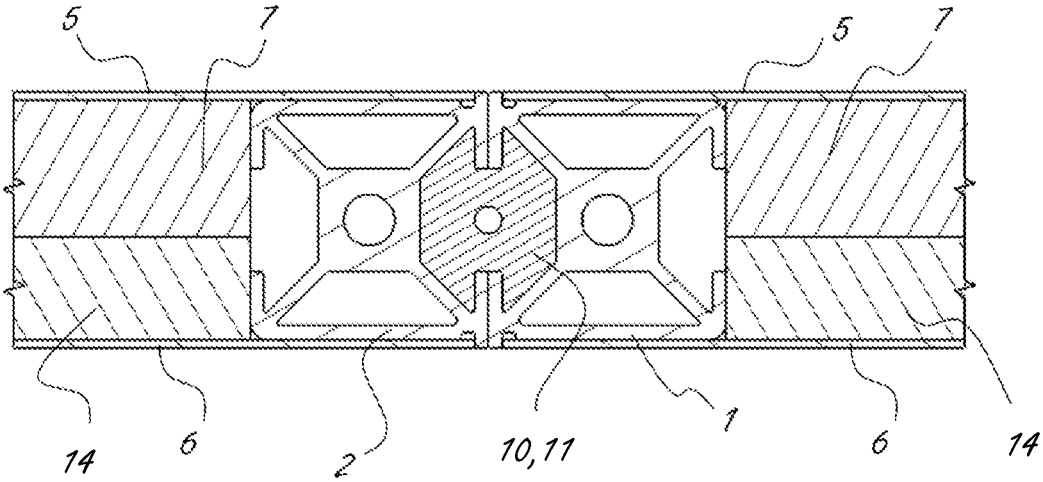
FIG. 9 illustrates an alternate horizontal cross-section connection detail of two coupled unique multi-component building panels with a connector.

FIG. 9 shows an alternate horizontal cross-sectional view of two of the unique multi-component, structural modular building panel assemblies linked, utilizing item 10, a connector. This illustrates another embodiment of the invention within item 10, the connector, doubles as item 11, a weather strip. Another embodiment is illustrated by item 14, an optional internal backing board which can be added to the unique multi-component building panels as required, depending on the application of the said panels.

Figure 10:
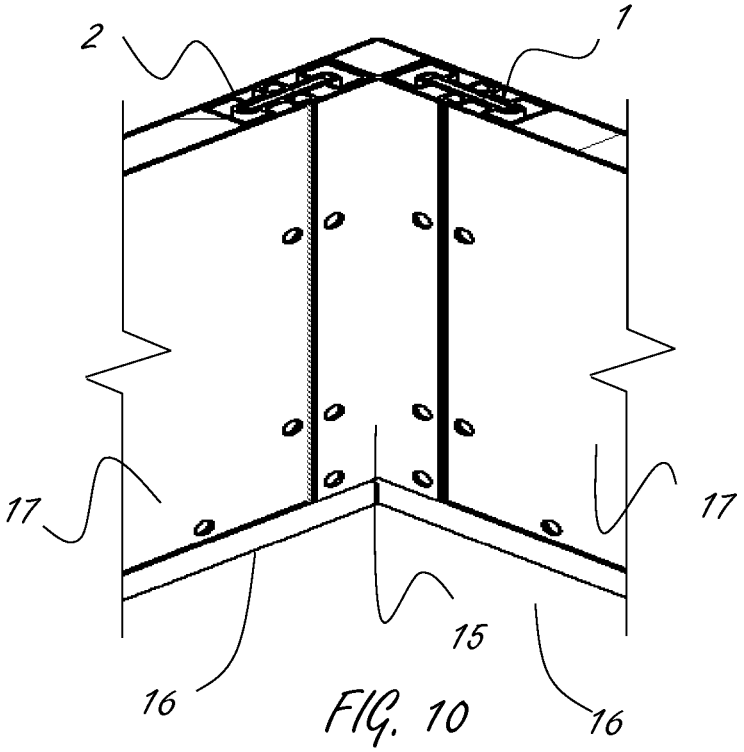
FIG. 10 illustrates an isometric cross-sectional view of a unique corner assembly comprising two uniquely prefabricated multi-component wall panels coupled with a unique corner member with a unique proprietary connecting shape.

FIG. 10 shows an isometric cross-sectional view of a unique corner assembly, comprising of two of the uniquely prefabricated multi-component wall panels, items 17, with items 1 and 2, the unique side frame edge members with a unique proprietary connecting shape, joined with item 15, a unique corner member with a unique proprietary connecting shape, which may be an FRP pultrusion or any other suitable material, to form perpendicular corners of the unique modular building system. The said uniquely prefabricated multi-component wall panels and the said unique corner member mates with items 16, unique track members with a unique proprietary connecting shape, which may be a composite FRP pultrusion or any other suitable material. The said unique track members can be fixed to item 21, a floor or foundation or any other suitable structure. The said unique corner member, in a suitable configuration of geometry, can be used as a unique eave member, item 23, to connect a uniquely prefabricated multi-component roof panel, item 18 and a uniquely prefabricated multi-component gable panel, item 25. The said unique track member can be also be used to couple the multi-component, structural building panel with traditional construction, which can be applied as an internal wall system, structural or non-structural as dictated by the application, or any other suitable configuration.

Figure 11:
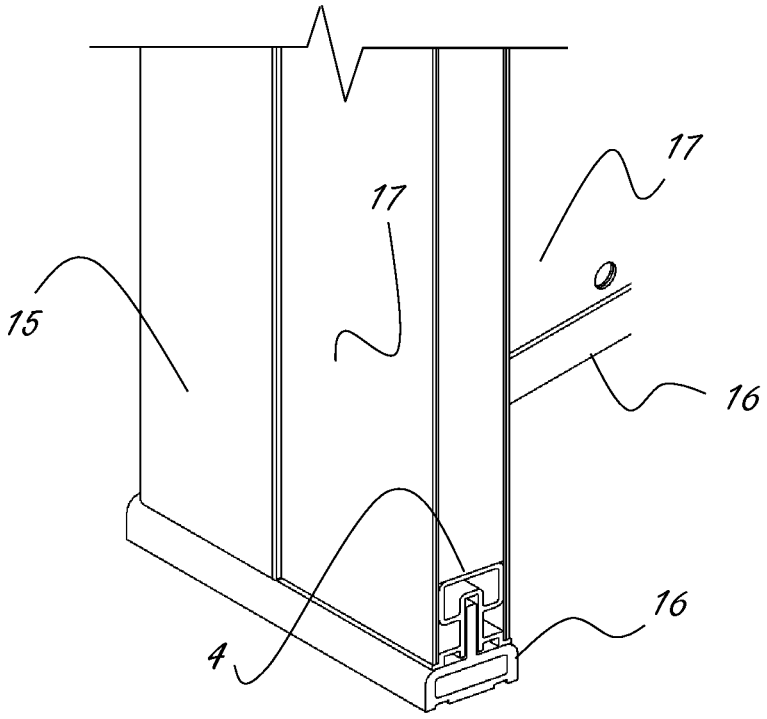
FIG. 11 illustrates a vertical cross-section of the connection detail of a unique panel to track assembly, comprising of a unique track member with a unique proprietary connecting shape linked with the unique bottom frame edge member of the uniquely prefabricated multi-component wall panel.

FIG. 11 shows an isometric, vertical cross-section view illustrating the detail of item 16, the unique track member with a unique proprietary connecting shape, mating with: item 4, the unique bottom frame edge member with a unique proprietary connecting shape of the uniquely prefabricated multi-component wall panel, item 17; and the unique corner member with a unique proprietary connecting shape, item 15.

Figure 12:
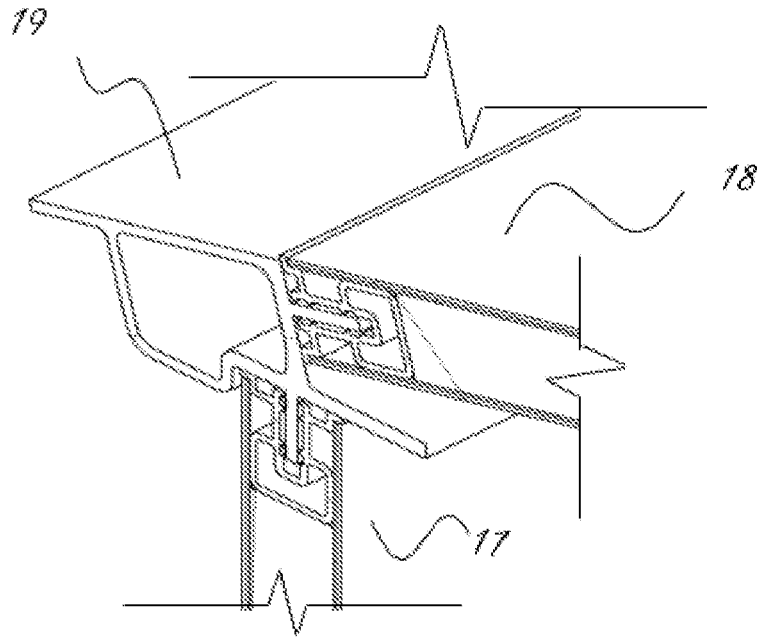
FIG. 12 illustrates a vertical cross-section of the connection detail of a unique wall panel to roof panel assembly, comprising of the uniquely prefabricated multi-component wall panel and a uniquely prefabricated multi-component roof panel linked by a unique roof wall connector with a unique proprietary connection shape.

FIG. 12 shows a vertical, isometric cross-sectional view illustrating a unique wall panel to roof panel assembly, comprising the uniquely prefabricated multi-component wall panel, item 17, coupled with the uniquely prefabricated multi-component roof panel, item 18, and linked by a unique roof wall connector with a unique proprietary connecting shape, item 19, which may be an FRP composite pultrusion or any other suitable material manufactured by any other suitable method. The inclination of the roof is dictated by this roof wall connector, therefore, this connector can be swapped out with a connector of different inclination and geometry, as dictated by the requirements of design.

Figure 13:
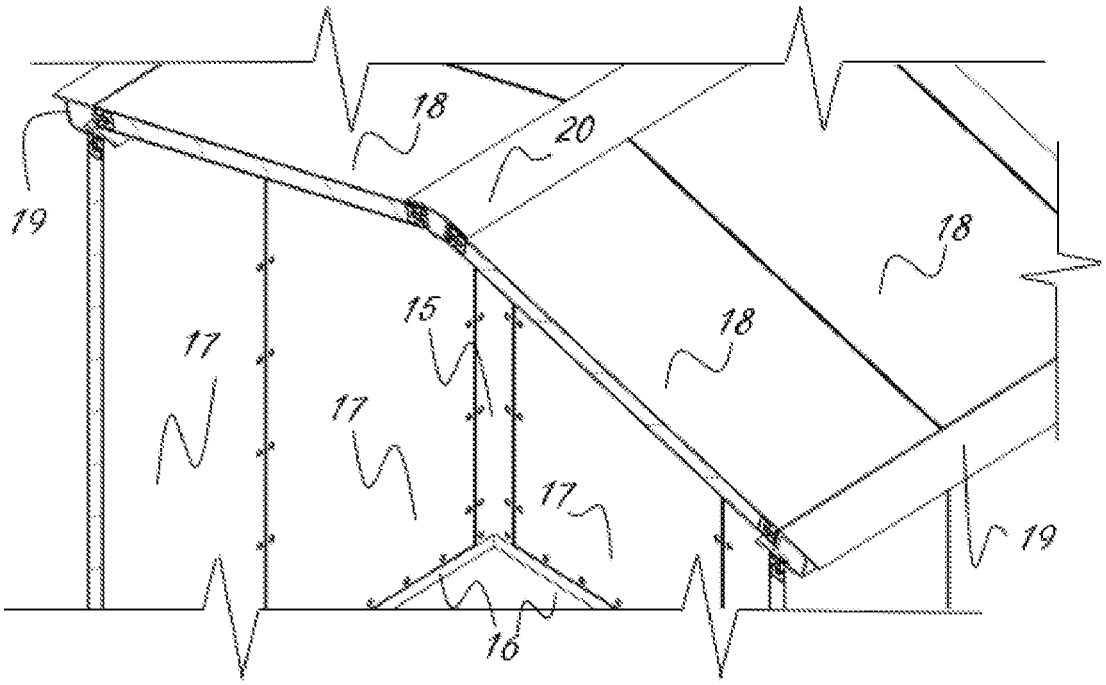
FIG. 13 illustrates an isometric cross-sectional view of a partial unique structural modular building system, comprising of the unique corner assembly of FIG. 10 linked to the expandable unique wall panel to roof panel assemblies of FIG. 12, joined by a unique roof apex connector with a unique proprietary connecting shape.

FIG. 13 shows an isometric cross-sectional view of components of a partial unique structural modular building system, comprising of the expandable building panel systems illustrated in FIG. 6; the unique corner assembly illustrated in FIG. 10 linked to the expandable unique wall panel to roof panel assemblies of FIG. 12, joined by a unique roof apex connector with a unique proprietary connecting shape, item 20, which may be an FRP pultrusion or any other suitable material. The components of the partial unique structural modular building system may be linked by the unique track member with a unique proprietary connecting shape, item 16. This illustrates an embodiment of the invention that may create a unique roof assembly such as an A-frame type configuration of a building structure and may include other panels, components or structures of conventional construction materials and methods. The unique roof assembly may be coupled with the unique track member with a unique proprietary connecting shape, item 16, and may be used as a stand-alone roofing option for conventional structures or buildings.

Figure 14:
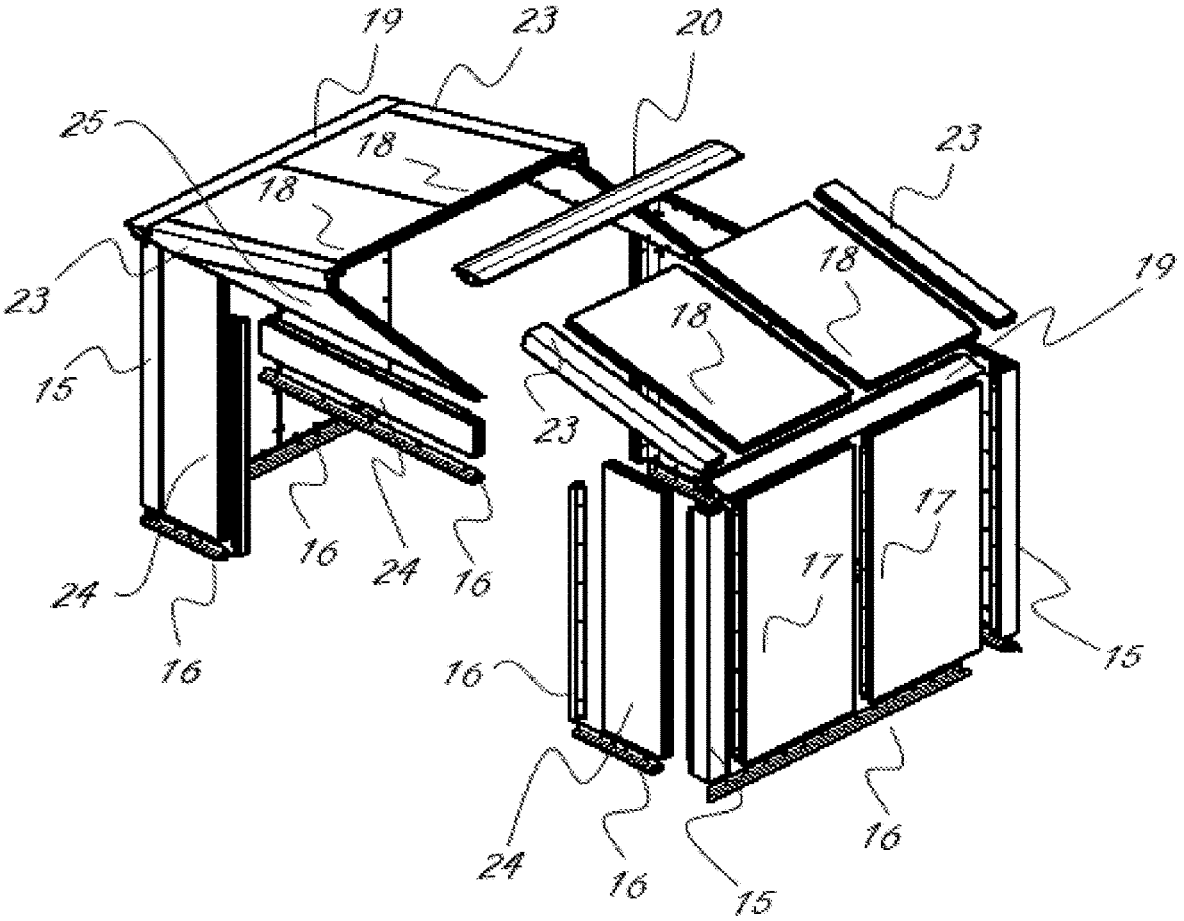
FIG. 14 illustrates an exploded view of a unique structural modular building system.

FIG. 14 shows an isometric exploded view of a unique structural modular building system comprising, the expandable building panel systems illustrated in FIG. 6; the unique corner assembly illustrated in FIG. 10; linked to the expandable unique wall panel to roof panel assemblies of FIG. 12; joined by a unique roof apex connector with a unique proprietary connecting shape, item 20. The unique corner members with a unique proprietary connecting shape, items 15, are used as the unique eave member, items 23, to link the uniquely prefabricated multi-component roof panels, items 18 to the uniquely prefabricated multi-component gable panels, items 25, and to the uniquely prefabricated multi-component closing panels, items 24, to create the unique gable assemble that completes the façade of the unique structural modular building system. The components of the unique structural modular building system are coupled with the unique track members with a unique proprietary connecting shape, items 16; and/or conventional construction materials and methods to create walls, corners, roofs, segments of a structure or complete buildings.

Figure 15:
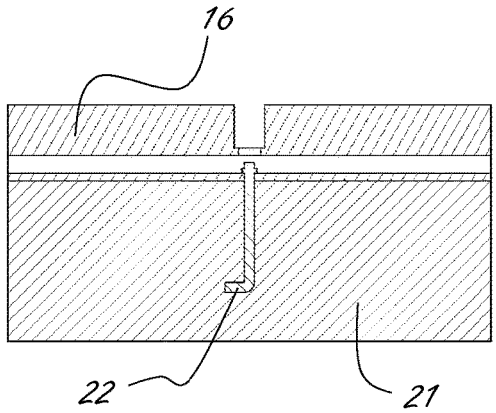
FIG. 15 illustrates a vertical cross-section of the unique track member with a unique proprietary connecting shape, fixed to a floor, foundation or other suitable material by means of an anchor bolt or other suitable system.

FIG. 15 shows a vertical cross-sectional view of the unique track member with unique proprietary connecting shape, item 16, fixed to a floor, foundation or any other suitable material, conventional structure or construction elements, item 21, by using an anchor bolt and/or any suitable anchoring and/or fastening system, item 22. This embodiment of the invention allows the unique structural modular building system to be compatible with conventional construction materials and methods.

Figure 16:
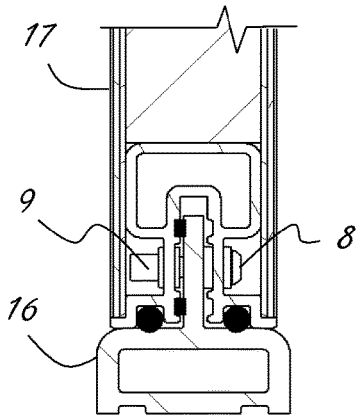
FIG. 16 illustrates a vertical cross-section of the unique panel to track assembly of FIG. 11, (which is the unique track member with a unique proprietary connecting shape, linked with the unique prefabricated multi-component wall panel), secured by means of a fastening nut and bolt.

FIG. 16 shows a vertical cross-sectional connection detail view of the unique panel to track assembly of FIG. 11, illustrating the unique track member with a unique proprietary connecting shape, item 16, mating with the uniquely prefabricated multi-component wall panel, item 17 and attached with a fastening bolt and a nut, or any other suitable fasteners or fastening mechanism, items 8 and 9.

Figure 17:
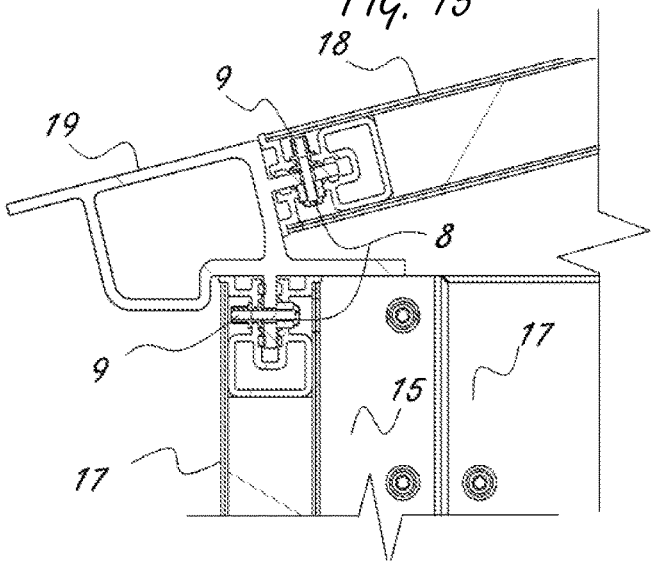
FIG. 17 illustrates a vertical cross-section of the unique wall panel to roof panel assembly of FIG. 12, (which is the unique prefabricated multi-component wall panel and the unique prefabricated multi-component roof panel linked by a unique roof wall connector with a unique proprietary connection shape), secured by means of fastening nuts and bolts.
Figure 18:
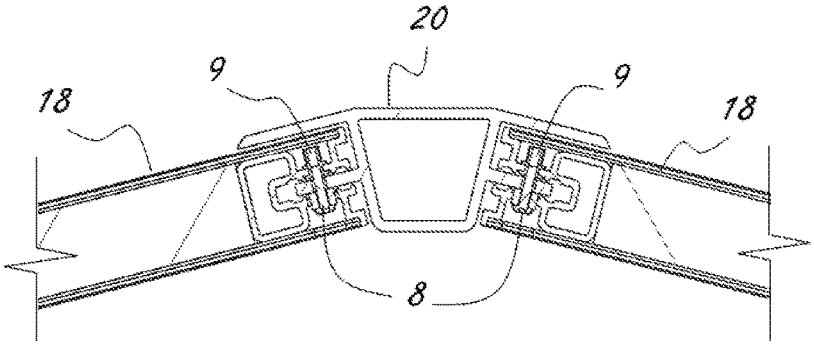
FIG. 18 illustrates a vertical cross-section of the connection detail of the unique roof apex connector with a unique proprietary connecting shape, linking the unique prefabricated multi-component roof panels, secured by means of fastening nuts and bolts.

FIG. 17 shows a vertical cross-sectional connection detail view of the unique wall panel to roof panel assembly of FIG. 12 linked to the unique corner assembly of FIG. 10, which is comprised of two of the uniquely prefabricated multi-component wall panels, items 17, joined with the unique corner member with a unique proprietary connecting shape, item 15; linked to the unique prefabricated multi-component roof panel, item 18, by a unique roof wall connector with a unique proprietary connection shape, item 19, attached with fastening bolts and nuts, or any other suitable fasteners or fastening mechanism, items 8 and 9. The unique roof wall connector with a unique proprietary connecting shape, item 19, may be replaced by the unique track member, item 16, with a unique proprietary connecting shape to allow the roof assembly to be compatible with conventional construction materials and methods and be coupled with conventional roofing methods or off the shelf-roofing products FIG. 18 shows the vertical cross-sectional connection detail view of a unique roof assembly comprising of two of the unique prefabricated multi-component roof panels, items 18, linked by the unique roof apex connector with a unique proprietary connecting shape, item 20, attached with fastening bolts and nuts, or any other suitable fasteners or fastening mechanism, items 8 and 9. A roof segment comprising the unique roof apex connector with a unique connecting shape, item 20, may be a composite FRP pultrusion or any other suitable material, may be coupled with the uniquely prefabricated, multi-component, structural modular building panel, and/or the expandable roof panel system, to construct a roof segment, roof or other similar structure of a building.

Figure 19:
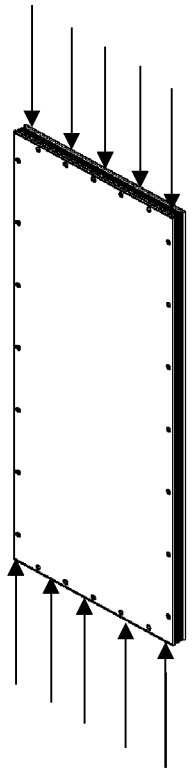
FIG. 19 illustrates the axial compression and loading direction on the uniquely prefabricated, multi-component, structural modular building panel.

FIG. 19 shows the isometric view of the uniquely prefabricated, multi-component, structural modular building panel subjected to axial compression loading.

Figure 20:
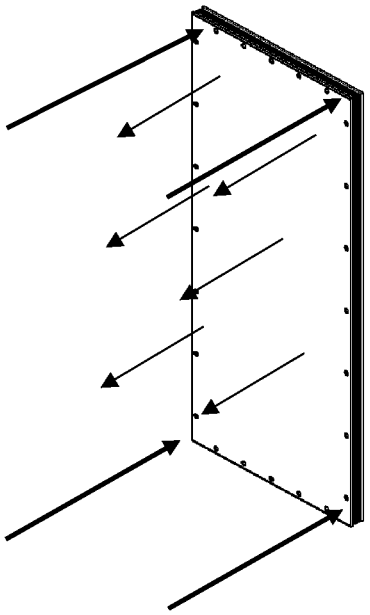
FIG. 20 illustrates the lateral bending load direction on the uniquely prefabricated, multi-component, structural modular building panel.

FIG. 20 shows the isometric view of the uniquely prefabricated, multi-component, structural modular building panel subjected to a lateral bending loading condition.

Figure 21:
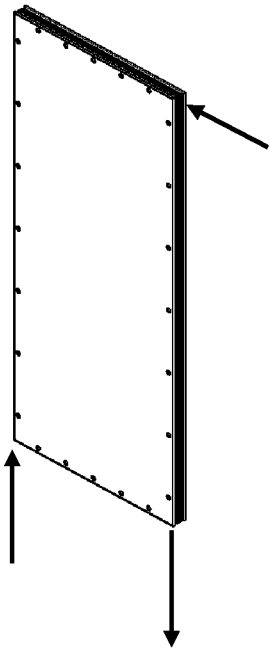
FIG. 21 illustrates the shear loading direction on the uniquely prefabricated, multi-component, structural modular building panel.

FIG. 21 shows the isometric view of the uniquely prefabricated, multi-component, structural modular building panel subjected to a racking shear loading condition.

DETAILED DESCRIPTION OF THE INVENTION

In the following detailed description, reference is made to the accompanying drawings, which form a part hereof. In the drawings, similar symbols typically identify similar components, unless context dictates otherwise. The illustrative embodiments described in the detailed description, drawings, and claims are not meant to be limiting. Other embodiments may be utilized, and other changes may be made, without departing from the spirit or scope of the subject matter presented herein. It will be readily understood that the aspects of the present disclosure, as generally described herein, and illustrated in the Figures, can be arranged, substituted, combined, separated, and designed in a wide variety of different configurations, all of which are implicitly contemplated herein.

The structural modular building panel which is illustrated in FIG. 1 can be joined with other panels of the same construction to build a wall, roof, or other similar structure of a building. These expandable panel systems may be attached by the unique track member with a unique proprietary connecting shape, and/or attached to other panels, components or structures of conventional construction materials and methods, to be used as structural or non-structural wall partitions, roof panels or similar segments of a structure. The structural modular building panel is a multi-component assembly which is comprised of primary components of a plurality of unique frame edge members with a unique proprietary connecting shape along the perimeter of the panel (proprietary edge profiles) 1, 2, 3, 4; at least one or more thin face sheets 5, 6 of advance composites, fiber reinforced polymer (FRP) or any other suitable material; and an insulating core 7, which may be rigid foam or any other suitable material. FIGS. 1 through 5 illustrate the general fabrication assembly of a single panel. The various components and arrangement thereof shown in FIG. 1 is merely illustrative, and other variations, including eliminating components, combining components, and substituting components, or rearranging components are all contemplated, which may be dictated by the requirements of design and the application of the panel within the building system.

The frame edge members with a unique proprietary connecting shape 1, 2, 3, 4, have a uniform cross section that runs along the length of the component. The cross section is of a design which allows the unique frame edge members with a unique proprietary connecting shape to function as a structural member and point of connection, and may hold channels for electrical wiring, and plumbing.

The frame edge members with a unique proprietary connecting shape 1, 2, 3, 4, incorporate similar mating profiles (unique proprietary connecting shapes) or an interlocking shape as illustrated in FIGS. 7 and 8, that allows for the easy connection of a panel to an adjacent panel or other component with the same mating profile (unique proprietary connecting shape). The side frame edge member with a unique proprietary connecting shape on item 1 will join with the side frame edge member with a unique proprietary connecting shape of item 2 on an adjoining panel. The upper and bottom frame edge member with a unique proprietary connecting shape of items 3 and 4 may or may not be the same unique proprietary connecting shape as items 1 and 2. The unique proprietary connecting shape on items 3 and 4 will allow for easy connections of the panel to upper and lower mating components. FIG. 6 illustrates a horizontal cross-section view of a connection between two panels where the side frame edge member with a unique proprietary connecting shape 2 of the first panel connects to the side frame edge member with a unique proprietary connecting shape 1 of the second panel joined by means of a connector 10. The unique frame edge members of the uniquely prefabricated, multi-component, structural modular building panels are coupled with connectors to a plurality of said panels, to form expandable building panel systems, such as expandable wall panel systems, expandable roof panel systems or similar segments of a structure.

The frame edge members with a unique proprietary connecting shape 1, 2, 3, 4 incorporate mechanical fasteners 8 and 9 to transfer structural loads from one panel to an adjoining panel or other mating component. The fastening nut 9 may be a rivet nut or any other suitable fastening hold. The fastening bolt 8 or any other suitable fastener, may have a flange or a collar which puts positive pressure on the connector 10 when secured. The components of the unique modular building system and/or the unique structural modular building system illustrated in FIG. 14, may be fastened together from the inside of the building structure with mechanical fasteners such as bolts and nuts, or other suitable fastening mechanisms, to form a secured building structure that may not be disassembled from the outside.

The frame edge members with a unique proprietary connecting shape 1, 2, 3, 4 may be made from composite FRP, manufactured by a pultrusion process, or any other suitable material manufactured by any other suitable method that satisfies the structural requirements of the application and/or structure. In some embodiments, they may also be made of structural material such as other thermoset composites, aluminum or other metals, or wood, or any other suitable material.

The frame edge members with a unique proprietary connecting shape 1, 2, 3, 4 can be pultruded, although they may also be made by other manufacturing methods including extrusion, forming, milling, or any other suitable methods based on the material used to manufacture and is dictated by the structural performance requirements of the structural modular building system.

The unique frame edge members with a unique proprietary connecting shape 1, 2, 3, 4 may have a hollow section which can be used as a channel or conduit for mechanical services, or any other use such as utilities, electrical and plumbing lines.

The uniquely prefabricated, multi-component, structural modular building panel, illustrated in FIGS. 4 thru 9, incorporate unique edge frame members with a unique proprietary connecting shape that have cavities for a weather strip or any other suitable material, fastening bolts and nuts or any other suitable fastening system, and/or run-outs for excess adhesive/bonding material. The outer connecting faces of the unique frame edge members with a unique proprietary connecting shape may incorporate a weather strip 11, gasket, caulking, or similar which provides an environmental seal between joined panels. If the frame edge members with a unique proprietary connecting shape are made by extrusion, or any other suitable method, the weather seal can be produced simultaneously as a co-extrusion or any other suitable method.

The frame edge members with a unique proprietary connecting shape 1, 2, 3, 4 surround the complete perimeter of the panel, which seals off the interior of the panel and protects it form dirt, debris, and water ingress to the core of the panel. The components of the structural modular building panel are uniquely prefabricated by coupling the unique frame edge members with a unique proprietary connecting shape to the face sheets and then bonding together the components using an epoxy adhesive or any other suitable material or method, which may also seal the said panel from environmental elements.

The face sheets 5 and 6 are preferably made from a fiber reinforced thermoset composite, however they may also be made from other advance composites, metals such as steel or aluminum, wood, or cementitious material, or may be any other suitable material to provide the required performance characteristics and properties.

Exterior face sheet 5, may be of a composition to provide an appropriate exterior finish and provide protection from the environmental elements and interior face sheet 6 may be of a composition to provide an appropriate interior finish and meet interior fire code requirements. Exterior and interior face sheets 5 and 6, may or may not be textured, patterned, or formed with three dimensional features.

The insulating core 7 may be a lightweight rigid material with sufficient properties to provide the required structural and insulating performance.

The insulating core 7 may be an insulative material such as polyurethane foam, expanded polystyrene foam, polyisocyanurate foam, or phenolic foam, or may be any other suitable material. In applications where structural requirements supersede insulation requirements, other lightweight and/or rigid structural core materials may be used such as a honeycomb material.

The face sheets 5 and 6 are thin, relative to the core 7, and typically have a thickness in the range of 1 mm to 10 mm. The core 7 typically has a thickness in the range of 25 mm to 250 mm.

The core 7 may be a single piece, may have cutouts for internal panel features, or may be multiple pieces placed around other internal features or may be any other suitable material.

Internal reinforcing elements and features 12 such as webs, rods, or other structural members may be included on the interior of the panel which join face sheets 5 and 6 to each other for improved structural performance of the panel. The internal joining features may be of the same construction as the frame edge members with a unique proprietary connecting shape. FIG. 4 illustrates a panel section view which includes an internal reinforcing element 12. The uniquely prefabricated, multi-component, structural modular building panel may incorporate prior to sealing the panel, an internal reinforcing element made of composite FRP, or any other suitable material, which may be added at the midpoint or any other location within the panel dictated by the function and the structural performance requirement of the panel and building system.

The mechanical fasteners 8 and 9 which transfer structural loads from one panel to an adjoining panel or other mating component are rigid connectors such as nuts and bolts or may be any other suitable device. They should be of a type and configuration that allows for simple connection and fastening with a limited number of common tools. FIGS. 10 thru 13 provide further examples of different unique members, unique connectors and unique assemblies with unique proprietary connecting shapes. The components of the unique modular building system and/or the unique structural modular building system illustrated in FIG. 14, may be assembled using common tools and semi-skilled labor and be installed in a way such that they can be reconfigured, disassembled, transported and re-used.

The mechanical fasteners 8 and 9 are fastened to or installed through the frame edge members with a unique proprietary connecting shape 1, 2, 3, 4. They may be fixed on the interior face of the frame edge members with a unique proprietary connecting shape 1, 2, 3, 4, depending on the connection configuration. The quantity, configuration, and placement of mechanical fasteners on a panel may be defined based on the structural performance requirements of the structural modular building system.

FIGS. 6 and 9 provide examples of panel connections where adjacent panels are connected by a flat bar connector 10 to the frame edge members with a unique proprietary connecting shape 1 and 2. FIG. 6 shows a configuration where the mechanical fasteners 8 and 9 are installed internal to the frame edge members with a unique proprietary connecting shape, and FIG. 9 shows a configuration where the mechanical fastening is through the interlocking action of the joining flat bar connector 10, which also doubles as a weather strip 11. FIG. 16 shows an example of the unique panel to track assembly with the connection of the panel bottom of item 17 to the unique track member with a unique proprietary connecting shape 16 using mechanical fasteners 8 and 9.

The face sheets 5 and 6 are bonded to the frame edge members with a unique proprietary connecting shape 1, 2, 3, 4 by an adhesive layer 13 or other suitable means such as curing the face sheet material in-situ with the frame edge members with a unique proprietary connecting shape. The unique shape of the edge frame members includes features to center the sheet in position during the assembly process.

The face sheets 5 and 6 are bonded to opposite faces of the foam core 7 by an adhesive layer 13 or other suitable means such as curing the face sheet material in-situ with the foam or curing the foam in-situ with the face sheets.

The frame edge members with a unique proprietary connecting shape 1, 2, 3, 4, and the face sheets 5, 6 and the foam core 7 may be bonded together using an epoxy adhesive or a suitable bonding material and using a hydraulic or pneumatic press or vacuum table, or other suitable method to apply positive pressure on the panel, to ensure the uniform distribution of the adhesive layer and to achieve adequate bonding between the face sheet and the foam core.

Features such as internal fasteners 8 and 9, and internal reinforcing element 12, may be installed before complete panel assembly occurs, and before face sheets 5 and 6 are bonded to the frame edge members with a unique proprietary connecting shape 1, 2, 3, 4. This ensures the fasteners are sealed off to the exterior environment, providing protection from rusting, while also being a secure connection accessible only from within the building structure.

A major advantage allowed by the multi-component panel assembly is the design flexibility that is possible compared to a fully pultruded panel, or a panel made primarily with a single manufacturing procedure. Pultruded building panels can be produced to different lengths, however the cross-section dimensions, i.e., the panel width, cannot be varied. A multi-component panel design allows for common frame edge members with a unique proprietary connecting shape 1, 2, 3, 4 to be used to create different panel sizes without further investment in different manufacturing tools or dies. The frame edge members with a unique proprietary connecting shape can be produced or cut to different lengths and can be assembled with different sizes of faces 5, 6 and cores 7. The panel thickness set by the frame edge member with a unique proprietary connecting shape would remain constant, but the overall panel width and length can be made to different dimensions. Additionally, different face sheets 5, 6 and different core 7 materials can be used with common frame edge members with a unique proprietary connecting shape to produce a panel with different properties, levels of performance, or aesthetics. The flexibility of the multi-component building panels and building systems allows different materials and processes to be used as dictated by the structural performance and environment protection as required by the building system, making it adaptable to any environment, and it may be used in any geographic location.

Manufacturing techniques which can produce more complex forms are only needed to produce the frame edge members with a unique proprietary connecting shape 1, 2, 3, 4. The middle portion of the panel is substantially flat therefore a custom die may not be required, and the face sheets 5 and 6 can be manufactured with processes which are more efficient for producing sheet material. This creates the potential to produce a more cost-effective panel, and the initial investment required to manufacture a new panel may be smaller. For example, the die required for a custom pultruded edge piece would be smaller than the die required for a completely pultruded panel with the same edge profile. A smaller custom die results in lower die manufacturing costs and therefore a lower initial investment is needed for manufacturing of a new panel.

The multi-component panel design may help to mitigate the limitations of manufacturer capabilities and maximum dimensions. For example, a fully pultruded panel would be limited to the cross-section dimensions which a pultrusion manufacturer is capable of manufacturing to, however with pultruded edges, the overall panel can still be made to larger dimensions if the other panel components can be manufactured to the larger desired dimensions.

Panels may be assembled, or mass manufactured in a factory setting to achieve optimal production efficiency and reduction of the environmental impact. Greenhouse gases (GHG) and CO2 emissions are greatly reduced as the factory uses renewable and sustainable resources for energy such as hydro, wind and solar electricity. Innovations in sustainable energy may be implemented in the factory as they are made available to the industry.

The frame edge members with a unique proprietary connecting shape 1, 2, 3, 4 act as structural members, and behave as load bearing columns or beams depending on the panel orientation and the loads imposed on the panel.

The face sheets 5 and 6 bonded to the insulating core 7 or any other suitable material, may behave as an integral structural member commonly known as a sandwich panel. The sandwich panel structure may carry axial and/or lateral loads and/or racking shear loads.

The face sheets 5 and 6 bonded to the frame edge members with a unique proprietary connecting shape 1, 2, 3, 4, and any internal reinforcing element 12, may act as integral structural members similar to an I-beam.

Axial loads may be carried by the frame edge members with a unique proprietary connecting shape 1, 2 or 3, 4, or the face sheets 5, 6, or a combination of these components individually or as combined structural units. FIG. 19 Illustrates an axial load on a panel used in a wall configuration. Frame edge member with a unique proprietary connecting shape 3 acts as a beam and carries the load to the frame edge members with a unique proprietary connecting shape 1 and 2. Frame edge members with a unique proprietary connecting shape 1 and 2 then act as columns to carry the load to the ground or other supporting structure. The face sheets 5 and 6 may or may not contribute to carrying the axial load depending on the specific panel design.

Lateral loads may be carried by the frame edge members with a unique proprietary connecting shape 1, 2, 3, 4, or the face sheets 5, 6, or a combination of these components individually or as combined structural units. FIG. 20 illustrates a uniformly distributed lateral load (pressure) such as a wind load perpendicular to the face of the panel. The distributed load is picked up by the face-sheets 5, 6 and core 7 which act together as a sandwich panel, and the load is carried to the frame edge members with a unique proprietary connecting shape 1 and 2. The frame edge members with a unique proprietary connecting shape 1 and 2 then act as a beam and carry the load to the top and bottom of the panel where the loads will be transferred to the adjoining structure.

FIG. 21 illustrates a lateral load applied parallel to the face sheets at the top corner of the panel which may represent the loads in the panel when being used as a shear wall in a greater building structure. The face sheets carry the shear loads and allow the entire panel to act as a rigid structure which can distribute the shear load to the ground.

The mechanical fasteners 8, 9 and the connector 10, provide the primary structural connections between panels and other structural components which allows for the creation of larger structures and buildings. Mechanical fasteners 8, 9 transfer tension loads such as hold-down loads, and shear loads such as racking loads between connected panels and other joining structural members and building components. Mechanical fasteners 8, 9 at the bottom corners of the panel carry the hold downloads to the joining structure. Mechanical fasteners 8, 9 may also tie additional panels together along the panel sides allowing the panels to act as a larger shear wall. Mechanical fasteners 22 anchor the building to the floor or foundation or any other suitable structure.

Internal reinforcements 12, as shown in FIG. 4, may be added to the panel where the structural capacity including shear resistance provided by the frame edge members with a unique proprietary connecting shape and/or the insulating core 7 or any other suitable material is not sufficient to meet the structural performance requirements of the structural modular building system.

The bonding of the frame edge members with a unique proprietary connecting shape 1, 2, 3, 4 to the face sheets 5, 6 allows the face sheets to contribute to the structure without relying on the sandwich panel action with the insulating core 7 or any other suitable material.

In structural sandwich panels, delamination of the face sheets from the core is a potential failure mode. The panel may be designed such that the frame edge members with a unique proprietary connecting shape 1, 2, or 3, 4, bonded to face sheets 5, 6 are the primary load bearing members and delamination of the sheets 5 or 6 from the insulating core 7 or any other suitable material does not create a critical risk for complete panel structural failure.

In structural sandwich panels, local wrinkling of the face sheets is a potential primary failure mode which is dependent on the properties of the face sheets and backing foam core or any other suitable material. The panel may be designed such that the frame edge members with a unique proprietary connecting shape 1, 2, 3, 4 and any internal reinforcing elements 12 are bonded to the face sheets 5, 6, and the structural function of the face sheets is not entirely dependent on the rigid backing of the structural foam core 7 or any other suitable material. The face sheets are held together as a single structural piece by the frame edge members with a unique proprietary connecting shape, internal reinforcements and any other suitable material or system. Hence, the design of the multi-component panel is governed by the structural requirements of the structural modular building system and careful consideration of the potential failure modes.

If the frame edge members with a unique proprietary connecting shape are designed as the primary load bearing members which carry the long duration loads (ex. dead load and snow load), face sheets may be made from materials which may not be suitable for carrying long duration loads. For example, face sheets may be made from a thermoplastic or any other material, which has less desirable creep performance but may still have adequate structural performance.

The panels may be designed and configured to different criteria such as structural, environmental, aesthetic, and dimensional requirements.

The panels may be designed, tested, evaluated, and certified in accordance with the relevant building codes and governing laws of the authorities having jurisdiction in the location where the panels are to be used to construct the structural modular building system in part or whole.

As an example, a factored roof load based on the National Building Code of Canada 2015 (NBCC 2015) for an area around Vancouver, British Columbia may be 112 psf. For a small structure such as a garage, this may produce a line load on supporting side walls of 896 lbs./ft, which would equal a factored load of 3584 lbs. on a single 4' wide panel. A 4' wide by 10' tall by 4" thick panel with FRP frame edge members with a unique proprietary connecting shape and ⅛" fiberglass face sheets may be designed with a load bearing capacity substantially higher than the required 3584 lbs.

The primary use for this invention of a multi component building panel is to pre-fabricate the said panel in a factory setting to create a modular panelized building system, where a plurality of like panels can be connected to construct a wall, a roof, and/or a similar structure. The components of the building system can be assembled using common tools and semi-skilled labor and be installed in a way such that they can be disassembled, transported and re-used.

The mating faces of the frame edge members with a unique proprietary connecting shape 1, 2, 3, 4, and/or the connector 10 may provide alignment for the connection to the adjacent panels. The engagement of the frame edge members with the connector, with a unique proprietary connecting shape, may also contribute to the transfer of structural loads between panels. Panels may be slid together or otherwise brought together based on the configuration of the connecting frame edge members with a unique proprietary connecting shape. The frame edge members with a unique proprietary connecting shape may provide engagement along the full length of the connecting panels. Panels may be joined with adequate force to bring the mating faces into contact and apply the sealing force required on the weather strip 11. The connection and seals may be designed such that a maximum of two people can connect the panels with the required assembling force. The connection, seals, mechanical fasteners and any other suitable material or system may also be designed such that the closure of the mechanical fasteners or any other suitable material or system may aid in closing the panel-to-panel connection and contributes to the application of the sealing force.

The panels may be designed such that they can be used as a complete wall system including the components of structure, structural connections, building envelope, insulation, and finishing. Walls built with these panels would therefore require fewer trades on site compared to a wall built with typical construction methods. Additionally, the on-site labor may be less skilled and/or semi-skilled.

The panel and the structural modular building system invention may be used in part or whole for different applications such as structural exterior walls, structural interior walls, non-structural interior walls or partition walls, roof panels, floor panels, fences, dividers, or barriers.

The panels may be designed and configured to different criteria such as structural, environmental, aesthetic, and dimensional requirements.

The panels may be designed such that they can accommodate additional finishing and cladding such as paint, drywall, or any other suitable material. The panels may also be designed such that they can accommodate installations such as shelves, any other suitable installations and items hung from said panel. The inclusion of an optional internal backing board 14 may facilitate the attachment of such finishes and installation when the face sheets and core are made from materials that do not easily allow for attachments.

Additional building system components which make use of the same mating unique proprietary connecting shapes as the frame edge members 1, 2, 3 and 4 of the panel may be developed to add to or create the complete modular building system. Items 15, 16, 19 and 20 provide examples of building components which connect to the panels. Additional building components which make use of the same mating unique proprietary connecting shape of the corner member 15; track members 16; or roof ridge member 19; or roof apex member 20; or the eave member item 23 with a suitable geometry configuration of the corner member 15; or other unique members or connectors may be designed and developed to add to or create a complete structural modular building system. Mating pieces may be made to facilitate the connection of the building panels or building component members of this invention to other building materials and other portions of a building. Components may be made to construct corners, connections to roofs and floor systems made with conventional building materials, and connections to foundations. Items 15, 16, 19 and 20 provide examples of building components which connect to the panels to construct corners, connections to roofs and floor systems. FIG. 10 illustrates a wall corner assembly comprising a wall corner member with a connection shape 15 and two or more multi-component framed walls panels 17. FIG. 16 illustrates a wall assembly with a track member 16, which facilitates the connection of the panel bottom to an adjoining floor, foundation or any other suitable material 21, or other structure using item 22, an anchor bolt or any suitable anchoring or fastening system, as shown in FIG. 15. FIGS. 12 and 13 provide examples of a roof system with the panels and a wall to roof connection piece 19, and a panel-to-panel roof apex connector 20. The wall panel and roof panel may or may not be of the same panel design or geometry configuration for a given application.

Complete building packages may be developed based on the use of the multi-component structural modular building panels, frame edge members with a unique proprietary connecting shape, corner frame edge members with a unique proprietary connecting shape, proprietary roof to wall profiles, proprietary roof peak profiles, other associated components and fastening mechanisms.

The panels may be designed to accommodate windows, doors, other openings, and features which may be required in a building. Panels may be designed with windows, doors, and openings installed as members of the multi-component panel, or may be made with openings to accommodate the installation of windows, doors, and other suitable pieces on-site.

Frame edge members with a unique proprietary connecting shape and/or proprietary track members may be designed such that they can facilitate the easy connection to typical building materials such as 2×4 or 2×6 lumber or any other conventional construction materials or structures.

Another embodiment of the invention is: the use of these uniquely prefabricated, multi-component framed panels and/or building components with unique proprietary connecting shapes, connections and fasteners may be designed in a way such that the building system can be disassembled, reconfigured, and/or re-used.

Another embodiment of the invention is: the use of these uniquely prefabricated, multi-component framed panels and/or building components with unique proprietary connecting shapes, and associated components may be used to create buildings, such as utility buildings, storage buildings, garages, outbuildings, offices, habitable structures including homes and any other required structures.

Another embodiment of the invention is: the use of these uniquely prefabricated, multi-component framed panels and/or building components with unique proprietary connecting shapes, may be useful for structures that require less customization and where standard panel dimensions may advantageous.

Another embodiment of the invention is: the use of these uniquely prefabricated, multi-component framed panels and/or building components with unique proprietary connecting shapes, may be mass produced to standard dimensions and compositions for cost efficiency.

Another embodiment of the invention is: the use of these uniquely prefabricated, multi-component framed panels and/or building components with unique proprietary connecting shapes may be manufactured in a low-volume production environment where high level of customization is required of the modular building structure.

Another embodiment of the invention is: the use of these uniquely prefabricated, multi-component framed panels and/or building components with unique proprietary connecting shapes, may be more advantageous when panels are designed to weights and dimensions which can be easily handled by a maximum of two people.

Another embodiment of the invention is: the use of these uniquely prefabricated, multi-component framed panels and/or building components with unique proprietary connecting shapes may be comprised of materials such as advance composites, additives such as graphene and any other suitable materials which are resistant to water and U.V. damage, molding, insect damage, and other forms of environmental degradation. Panels with such a composition and construction may be easier to clean, may require less maintenance, and may have a longer functional lifespan than typical construction materials such as wood, gypsum, steel, cement and aluminum.

Another embodiment of the invention is: the use of these uniquely prefabricated, multi-component, structural modular building panels, and/or building components with unique proprietary connecting shapes, may be advantageous where it is difficult to get the typically required manpower or equipment to a work site, where a worksite has poor or difficult access, and where a shortened timeline of on-site work is desirable. The panels may have a cost advantage over other building options. The panels may be easier to erect buildings or other structures when compared to other building materials and systems.

The use of these uniquely prefabricated, multi-component, structural modular building panels and/or building components with unique proprietary connecting shapes, or the invention's building systems may limit the amount of waste produced on-site compared to typical construction.

The use of these uniquely prefabricated, multi-component, structural modular building panels and/or building components with unique proprietary connecting shapes, or the invention's building systems, may minimize the number of different materials, supplies, and tools required on site. This may be particularly advantageous at remote work sites where access to construction supply stores is limited, expensive and/or difficult.

The use of these uniquely prefabricated, multi-component, structural modular building panels and/or building components with unique proprietary connecting shapes, or the invention's building systems, may be advantageous when building in adverse weather conditions which may delay or hinder typical construction. Manufacturing of the panels in a factory setting is not limited by the weather. The laborer's exposure to the weather on-site may be shortened compared to typical construction as on-site construction, and times may be decreased. Panels are made from water resistant materials such as composites or any other suitable material, that may make temporary storage and assembly in the rain possible.

The dimensions of factory-built buildings such as mobile homes and trailers are constrained by the on-road shipping limitations. Buildings are typically oversized shipping loads which incur additional shipping costs, and dimensions are limited by maximum widths and heights. A building constructed on site using the panels of this invention would not be limited by oversized shipping dimensions, on-road shipping limitations or other constraints, excluding material, and local jurisdiction laws, governance policies and building codes.

Traditional construction materials and methods involve a substantial amount of CO2 emissions that result in greenhouse gases (GHG) that contribute to climate change. Countries around the world have agreed to reduce GHG emissions and acknowledge that buildings generate nearly 40% of annual global GHG emissions. Data from the United Nations (UN) Environment Global Status Report 2017 and International Energy Outlook 2017 showed building materials and construction were responsible for 11% of Global CO2 emissions and building operations contributed 28%. Based on the data from these same studies, Architecture 2030 projected between 2020 and 2050, total carbon emissions for new construction will be almost equally distributed between embodied and operational carbon. Innovation is required to construct basic shelter to take on the challenges of a changing climate. This invention is environmentally friendly; has lower embodied carbon than traditional construction materials and methods; results in lower operational carbon and provides a platform that can incorporate current and future innovations that reduce GHG.

The continuous manufacturing process such pultrusion is cost-efficient and eco-friendly. The composite FRP is corrosion-resistant, fire retardant, durable, has dimensional stability, thermal insulation and low conductivity, which ensures longer lifespans, and reduced maintenance and operational costs.

Examples of situations where building with the panel of this invention may be advantageous:

- Building an outbuilding for storage where something more robust than a simple shed is desired.
- Building a garage in a cost-effective manner with a limited amount of time spent for construction on site.
- Building a workshop where the owner does not want to involve many trades.
- Building a remote cabin which only has access by a small truck. Panels can be taken to the site in smaller loads and easily assembled on site by a few people.
- Building a structure in a remote location where building supplies need to be transported by boat, plane, or helicopter.
- Building a semi-permanent structure, which may be disassemble and the panels re-used at a later date.
- Building a storage unit complex with a simple repetitious design.
- Building a work camp at a wilderness site which crosses a narrow bridge that a standard prefabricated trailer cannot be brought across.
- Building temporary housing for workers.
- Building a laneway house where there is tight access and a prefabricated building cannot be brought in, and the property owner wants construction on site completed quickly and efficiently.
- Building a tiny house where the homeowner would like to build the house themselves and they have a limited amount of experience with conventional building trades.
- Building low-cost housing of simple designs.
- Building emergency housing.
- Building in a location where skilled trades are limited.
- Building a resort community with simple cabins where daily travel time for labor required of typical construction would be prohibitively expensive.
- Building a fence or walled enclosure.

The previous description of the disclosed embodiments is provided to enable any person skilled in the art to make or use the present invention. Various modifications to those embodiments will be readily apparent to those skilled in the art, and the generic principles defined herein may be applied to other embodiments without departing from the spirit or scope of the invention. Thus, the present invention is not intended to be limited to the embodiments shown herein but is to be accorded the full scope consistent with the claims, wherein reference to an element in the singular, such as by use of the article "a" or "an" is not intended to mean "one and only one" unless specifically so stated, but rather "one or more". All structural and functional equivalents to the elements of the various embodiments described throughout the disclosure that are known or later come to be known to those of ordinary skill in the art are intended to be encompassed by the elements of the claims.

The embodiments of the invention in which an exclusive property or privilege is claimed are defined as follows:

1. A panel, comprising:

a first facing sheet, a second facing sheet and an insulating core between said first sheeting layer and said second sheeting layer, said first facing sheet and said second facing sheet being made form fiber reinforced polymer;

a first side frame edge member and a second side frame edge member located at opposed side edges of said panel, said edge members being substantially identical, each said edge member having a groove defined by a first side wall, a second side wall and an innermost wall, a first lesser groove between said first side wall and said first facing sheet and a second lesser groove between said second side wall and said second facing sheet, said first side wall and said second side wall each having a first indentation and a second indentation, a first weather strip and a second weather strip received in respective ones of said first indentation and said second indentation of either said first side wall or said second side wall, and a first tab extending from a side wall of each of said first lesser groove and said second lesser groove, each said tab extending over an edge of respective ones of said first facing sheet and said second facing sheet.

2. The panel of claim 1, further comprising:

an internal reinforcing element extending between said first sheeting layer and said second sheeting layer, said internal reinforcing element located at substantially a center of said panel.

* * * * *